US006651594B1

(12) United States Patent
Bagwell

(10) Patent No.: US 6,651,594 B1
(45) Date of Patent: Nov. 25, 2003

(54) ADULT/CHILD RESTRAINT HARNESS

(76) Inventor: Ian Bagwell, Box 76, Acme Alberta (CA), T0M 0A0

( * ) Notice: Subject to any disclaimer, the term of this patent is extended or adjusted under 35 U.S.C. 154(b) by 0 days.

(21) Appl. No.: 10/336,946

(22) Filed: Jan. 6, 2003

(51) Int. Cl.[7] ..... A62B 35/00
(52) U.S. Cl. ..... 119/770; 119/857
(58) Field of Search ..... 119/770, 769, 119/857; 2/311, 312, 313, 314, 321, 44; 434/283

(56) References Cited

U.S. PATENT DOCUMENTS

| | | | | | |
|---|---|---|---|---|---|
| 3,424,134 | A | * | 1/1969 | Rosenblum | 182/3 |
| 3,769,938 | A | * | 11/1973 | Hudziak et al. | 128/874 |
| 4,028,742 | A | | 6/1977 | Marquis | 2/305 |
| 4,308,629 | A | * | 1/1982 | Freemon | 441/111 |
| 4,324,205 | A | | 4/1982 | Goldmacher | 119/96 |
| 4,445,866 | A | * | 5/1984 | Cillieres | 434/253 |
| 4,560,097 | A | | 12/1985 | Reynolds et al. | 224/160 |
| 4,667,624 | A | * | 5/1987 | Smith | 119/770 |
| D297,673 | S | * | 9/1988 | Shapero | D29/101.1 |
| 4,854,607 | A | | 8/1989 | Mandracchia et al. | 280/801 |
| 5,052,704 | A | | 10/1991 | Nauman | 280/202 |
| 5,076,598 | A | | 12/1991 | Nauman | 230/202 |
| 5,145,027 | A | * | 9/1992 | Petzl et al. | 182/3 |
| 5,183,007 | A | | 2/1993 | Vincent | 119/96 |
| 5,190,306 | A | | 3/1993 | Nauman et al. | 280/202 |
| 5,435,272 | A | | 7/1995 | Epstein | 119/770 |
| 5,437,402 | A | * | 8/1995 | Ring | 224/159 |
| D383,256 | S | * | 9/1997 | Hampton | D30/153 |
| D391,682 | S | | 3/1998 | Palemas | D29/101 |
| 5,957,091 | A | * | 9/1999 | McDonald et al. | 119/770 |
| 6,006,700 | A | * | 12/1999 | Cox | 119/857 |
| 6,325,023 | B1 | * | 12/2001 | Elnatan | 119/770 |

* cited by examiner

*Primary Examiner*—Yvonne Abbott
(74) *Attorney, Agent, or Firm*—Sturm & Fix LLP

(57) ABSTRACT

An adult/child restraint harness (10) including an adult harness unit (11) and a child restraint harness (12) connected together by a tether unit (13) wherein, the adult harness unit (11) includes a chest harness member (20) and the child harness unit (12) includes a chest harness member (20) and the child harness unit (12) includes a full body harness member (40) having a pair of adjustable length leg strap members (51) each provided with an adjustable leg encircling strap (54) for pre-positioning the child's legs in a protective position relative to the child's chest so that the child's legs are the first to absorb the impact from an accident.

17 Claims, 2 Drawing Sheets

ADULT/CHILD RESTRAINT HARNESS

BACKGROUND OF THE INVENTION

CROSS REFERENCE TO RELATED APPLICATIONS

Not applicable.

1. Field of the Invention

The present invention relates to the field of restraint harness arrangements in general and in particular to a dual adult/child restraint harness arrangement.

2. Description of Related Art

As can be seen by reference to the following U.S. Pat. Nos. 5,435,272; 4,028,742; 5,183, 007; 5,052, 704; and, 4,560,097, the prior art is replete with myriad and diverse dual harness arrangements that are specifically designed to accommodate an adult and a child on a motorcycle, bicycle or personal water craft.

While all of the aforementioned prior art constructions are more than adequate for the basic purpose and function for which they have been specifically designed, they are uniformly deficient with respect to their failure to provide a simple, efficient, and practical adult/child restraint harness that not only provides a secure connection between the adult and the child, but which also incorporates a full body harness that will virtually insure that the child will remain within the confines of the harness regardless of the impact forces that are exerted against the adult/child restraint harness arrangement.

Unfortunately the prior art constructions are almost universally remiss in addressing the need for a full body restraint when it comes to the safety of the child which can lead to potentially fatal consequences.

As a consequence of the foregoing situation, there has existed a longstanding need among parents with small children for a new and improved adult/child restraint harness that focuses on providing the child with a full body harness that may be adjusted so as to maintain the child in a position wherein the child's legs are maintained in close proximity to their chest to absorb a substantial portion of an impact generated by a fall; and the provision of such an arrangement is the stated objective of the present invention.

BRIEF SUMMARY OF THE INVENTION

Briefly stated, the adult/child restraint harness that forms the basis of the present invention comprises in general an adult harness unit, a child harness unit and a tether unit for operatively connecting the adult harness unit to the child harness unit.

As will be explained in greater detail further on in the specification, the adult harness unit comprises a chest harness member having front and rear pairs of slidable D-rings and a unique tensioning strap arrangement disposed between the rear portions of the shoulder straps that are adjustably connected to the waist encircling strap that completes the chest harness member.

In addition, the child harness unit comprises a full body harness member having a unique leg strap restraint system as well as a single pair of slidable D-rings which are freely moveable between a pair of upper torso cross-straps wherein the rear cross-strap contains the same tensioning arrangement as is incorporated into the adult chest harness member; and, wherein the leg strap restraint system allows the adult to pre-position the child's legs in a defensive position in front of the child's chest to minimize impact to the child's chest in the event of an accident.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 3 is a rear perspective view of the child harness unit;

DETAILED DESCRIPTION OF THE INVENTION

Figure 1:
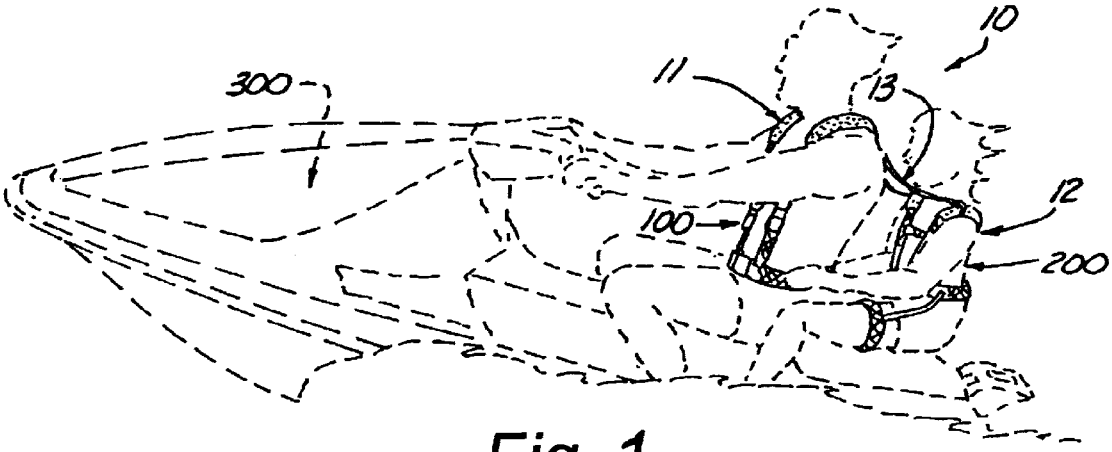
FIG. 1 is a perspective view of the adult/child restraint harness in use on a personal water craft.
Figure 5:
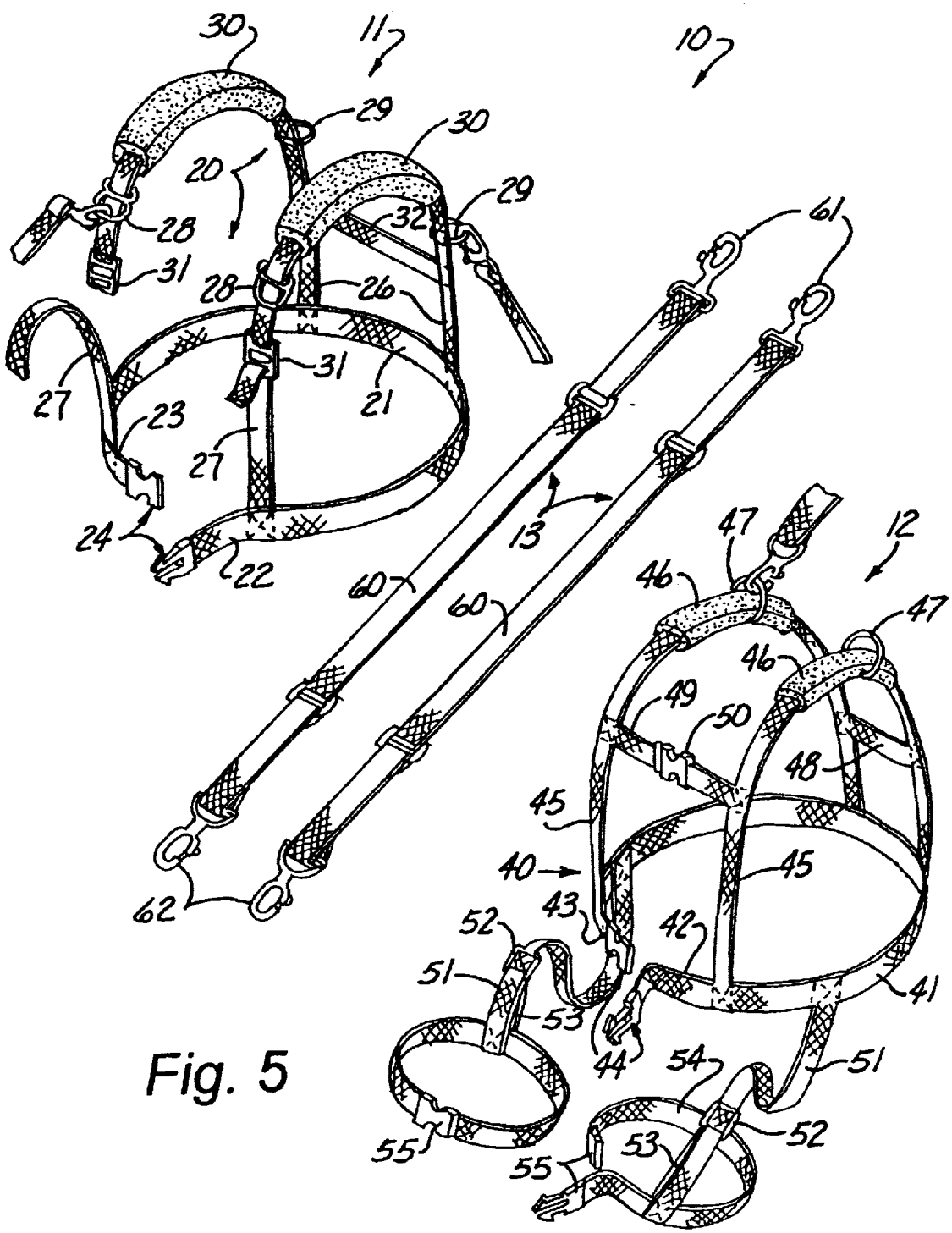
FIG. 5 is an exploded perspective view of the adult harness unit; the child harness unit and the dual tether unit.

As can be seen by reference to the drawings, and in particular to FIGS. 1 and 5, the adult/child restraint harness arrangement that forms the basis of the present invention is designated generally by the reference number 10. The harness arrangement 10 comprises in general an adult harness unit 11, a child harness unit 12 and a tether unit 13. These units will now be described in seriatim fashion.

Figure 2:
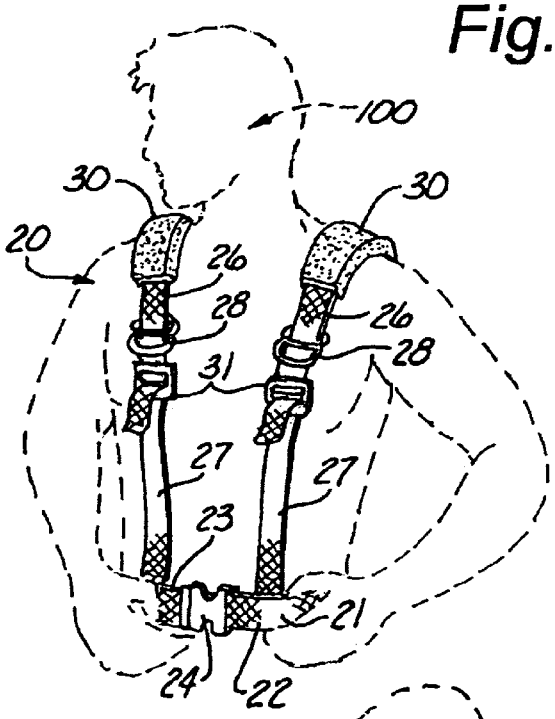
FIG. 2 is an isolated front perspective view of the adult harness unit.
Figure 4:
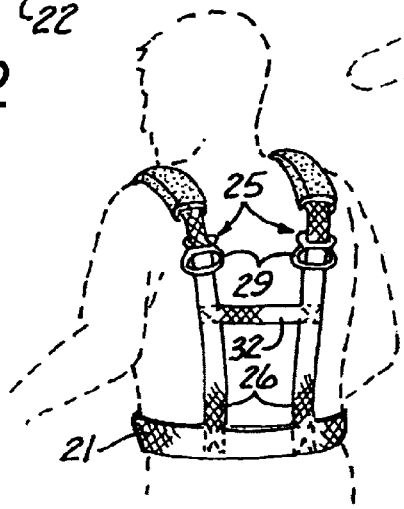
FIG. 4 is a rear perspective view of the adult harness unit.

As can best be seen by reference to FIGS. 2, 4, and 5, the adult harness unit 11 comprises a chest harness member 20 which includes a waist encircling strap 21 having a fixed length segment 22 and an adjustable length segment 23 provided with a bayonet style closure element 24 or other suitable cooperating fastener arrangement.

In addition, the chest harness member 20 includes a pair of shoulder straps 25 each having a fixed length segment 26 and an adjustable length segment 27 wherein the bottom ends of each of the segments 26 27 are fixedly secured to the waist encircling strap 21 in a well recognized manner.

Furthermore, the upper portion of the fixed length segments 26 are doubled over to receive a pair of slidable front D-rings 28 and a pair of slidable rear D-rings 29 separated from one another by a pair of slidable shoulder pads 30; wherein the free end of the fixed length segments 26 are provided with clasp elements 31 which are adapted to captively receive the free end of the adjustable length segments 27 in a well recognized manner.

Figure 3:
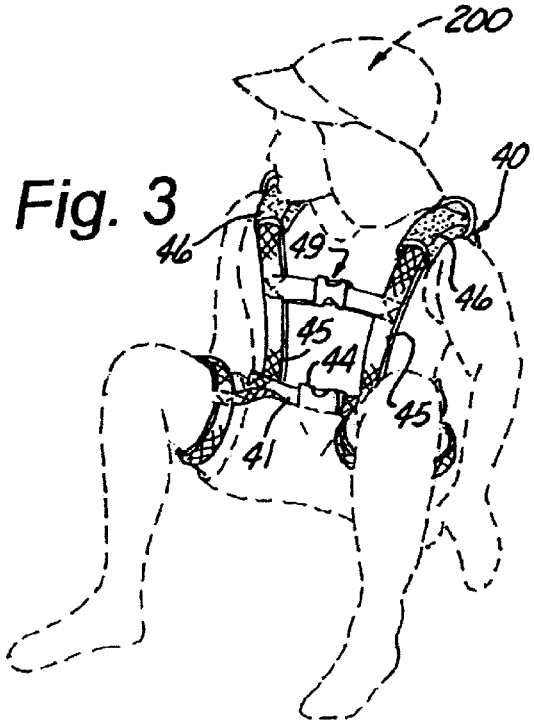
FIG. 3 is an isolated front perspective view of the child harness unit.

As can be best be appreciated by reference to FIGS. 4 and 5, the chest harness member 20 further includes an elasticized tensioning rear cross strap 32 that extends across the lower portion of the adult back between the fixed length shoulder strap segments 26 to both limit the downward travel of the pair of slidable rear D-rings 29 and to insure that the chest harness member 20 has a snug fit on the upper torso of an adult 100. Turning now to FIGS. 3 and 5, it can be seen that the child harness unit 12 comprises a full body harness member 40 including a waist encircling strap 41 having a fixed length segment 42 and an adjustable length segment 43 the free ends of which are provided with a bayonet style closure element 44 or other suitable cooperating fastener arrangement.

In addition, the waist encircling strap 41 is further provided with a pair of fixed length shoulder straps 45 each provided with a slidable shoulder pad 46 and an oversized slidable D-ring 47 whose forward and rearward movement on the individual fixed length shoulder straps 45 are limited by an elasticized tensioning rear cross-strap 48 and an adjustable length chest cross strap 49 the free ends of which are provided with a conventional fastener 50 so that the upper portion of the full body harness 40 captively engages the upper torso of a child in a well recognized manner.

Turning now to FIG. 5, it can be seen that the full body harness member 40 further includes a pair of adjustable length leg straps 51 fixedly secured on their upper ends to the waist encircling strap 41 and having a slidable clasp element 52 provided on their lower ends forming loops 53 that are adapted to receive a pair of adjustable length leg encircling straps 54 the free ends of which are provided with cooperating fasteners 55.

At this juncture, it should be noted that by employing adjustable length leg straps 51, an adult can custom fit the full body harness member 40 such that the child's knees can be drawn upwardly toward their chest as depicted in FIG. 3, so that in the event that both the adult and child are ejected from a personal water craft 300 or the like, the protective positioning of the child's legs will lessen any impact to the child's chest when they land in the water.

Turning now to FIGS. 1 and 5, it can be seen that the tether unit 13 comprises a pair of elongated adjustable length tether members 60 60 the opposite ends of which are provided with a pair of snap ring elements 61 62 adapted to engage the floating D-rings 47 on the full body harness member 40 and either the front 28 or rear 29 pair of D-rings on the chest harness member 20, depending on whether the child 200 is intended to be positioned in front of or behind the adult 100 on the vehicle 300.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An adult/child restraint harness comprising an adult harness unit including a chest harness member having a first pair of shoulder straps attached on their opposite ends to a first waist encircling strap a child harness unit including a full body harness member having a second pair of shoulder straps attached on their opposite ends to a second waist encircling strap means associated with said full body harness member for captively engaging a selected portion of the child's legs and positioning the child's legs proximate their chest; and, a tether unit including at least one adjustable length tether member adapted to be operatively connected between the adult harness unit and the child harness unit.

2. The restraint harness as in claim 1; wherein, at least one of said first and second pairs of shoulder straps are provided with a rear cross-strap.

3. The restraint harness as in claim 2; wherein, at least one of said first and second pairs of shoulder straps is provided with a front cross-strap.

4. The restraint harness as in claim 2; wherein, both the first and second pairs of shoulder straps are provided with a rear cross-strap.

5. The restraint harness as in claim 4; wherein, said rear cross-straps are elasticized.

6. The restraint harness as in claim 4; wherein, at least one of said first and second pairs of shoulder straps is provided with a front cross-strap.

7. The restraint harness as in claim 4; wherein, of said first and second pairs of shoulder straps are provided with D-rings.

8. The restraint harness as in claim 7; wherein, the tether unit includes a pair of tether members adapted to be selectively connected to the D-rings on the first and second pairs of shoulder straps.

9. The restraint harness as in claim 1; wherein, the first and second pairs of shoulder straps are each provided with a pair of shoulder pads.

10. The restraint harness as in claim 5; wherein, at least one pair of D-rings is dimensioned to slidably receive shoulder pads on a selected one of the first and second shoulder straps.

11. The restraint harness as in claim 10; wherein, the first pair of shoulder straps is provided with a front pair of D-rings and a rear pair of D-rings.

12. The restraint harness as in claim 11; wherein, the front and rear pair of D-rings are slidably disposed one the first pair of shoulder straps.

13. The restraint harness as in claim 12; wherein, the pair of shoulder pads on the first pair of shoulder straps limits the movement of the front and rear pairs of D-rings relative to the first pair of shoulder straps.

14. The restraint harness as in claim 13; the wherein, said means for captively engaging and selectively positioning child's legs comprises:

a pair of adjustable length leg straps wherein the upper ends of the leg straps are connected to the second waist encircling strap and each of the lower ends of the leg straps are operatively associated with an adjustable length leg strap.

15. The restraint harness as in claim 1; wherein, at least one of said first and second pairs of shoulder straps is provided with a front cross-strap.

16. The restraint harness as in claim 8; wherein, the first and second pairs of shoulder straps are each provided with a pair of shoulder pads.

17. The restraint harness as in claim 1; the wherein, said means for captively engaging and selectively positioning child's legs comprises:

a pair of adjustable length leg straps wherein the upper ends of the leg straps are connected to the second waist encircling strap and each of the lower ends of the leg straps are operatively associated with an adjustable length leg strap.

* * * * *